United States Patent [19]

Haas

[11] 4,339,324

[45] Jul. 13, 1982

[54] POLYCELL GAS GENERATOR

[75] Inventor: Richard M. Haas, Phoenix, Ariz.

[73] Assignee: Henes Products Corp., Phoenix, Ariz.

[21] Appl. No.: 212,274

[22] Filed: Dec. 3, 1980

[51] Int. Cl.[3] ..... C25B 9/00

[52] U.S. Cl. ..... 204/270; 204/257; 204/258; 204/269

[58] Field of Search ..... 204/254-258, 204/267-269, 129, 270

[56] References Cited

U.S. PATENT DOCUMENTS

| | | | |
|---|---|---|---|
| 1,660,147 | 2/1928 | Allan | 204/256 |
| 3,291,714 | 12/1966 | Hall et al. | 204/256 |
| 3,316,167 | 4/1967 | Clarke et al. | 204/270 |
| 3,451,906 | 6/1969 | Weed | 204/82 |
| 3,518,180 | 6/1970 | Grotheer | 204/268 |
| 3,616,436 | 10/1971 | Haas | 204/229 |
| 3,692,661 | 9/1972 | Shockcor | 204/269 |
| 3,824,172 | 7/1974 | Hodges | 204/269 |
| 3,864,236 | 2/1975 | Lindstrom | 204/256 |
| 3,957,618 | 5/1976 | Spirig | 204/270 |
| 3,990,962 | 11/1976 | Gotz | 204/268 |
| 3,994,798 | 11/1976 | Westerlund | 204/268 |
| 4,014,777 | 3/1977 | Brown | 204/270 |
| 4,124,478 | 11/1978 | Tsien et al. | 204/255 |
| 4,124,480 | 11/1978 | Stevenson | 204/268 |
| 4,196,069 | 4/1980 | Mose et al. | 204/257 |
| 4,206,029 | 6/1980 | Spirig | 204/228 |

FOREIGN PATENT DOCUMENTS

| | | | |
|---|---|---|---|
| 864245 | 4/1941 | France | 204/255 |

*Primary Examiner*—R. L. Andrews

*Attorney, Agent, or Firm*—Warren F. B. Lindsley

[57] ABSTRACT

An improved gas generator comprising a multiplicity of electrolytic cells arranged to accommodate a series current path, parallel electrolytic flow and minimized leakage current paths, in a stacked plate configuration that affords a high degree of portability at low cost.

10 Claims, 21 Drawing Figures

FIG. 9
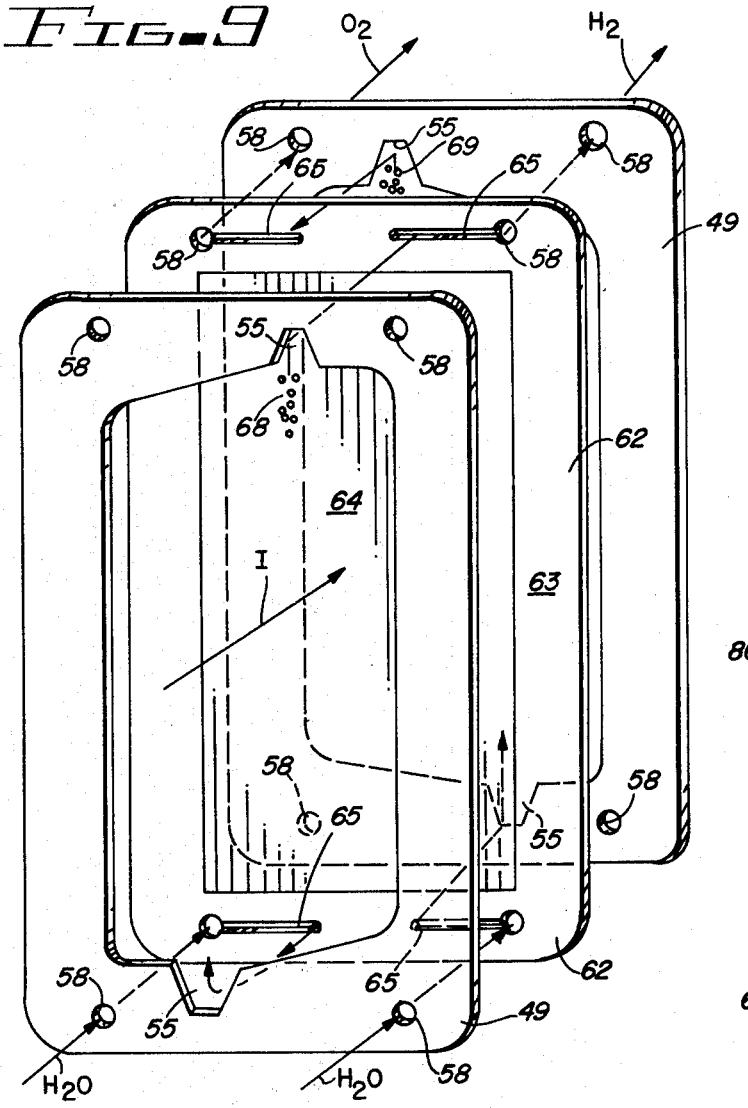
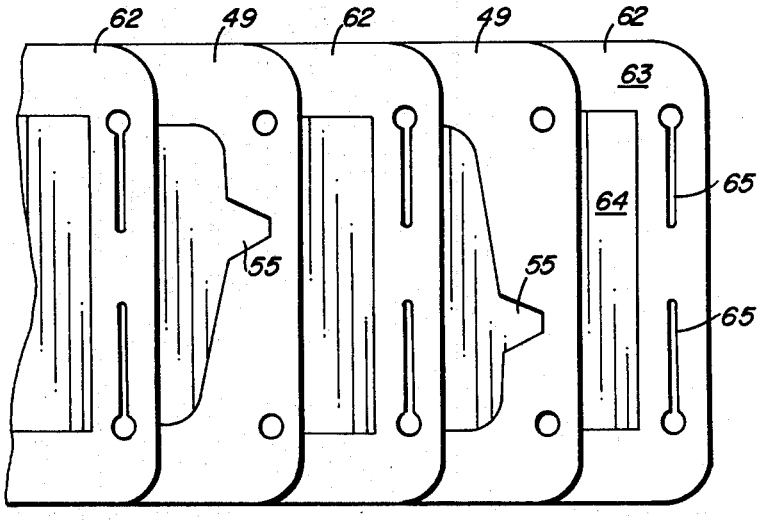
FIG. 12
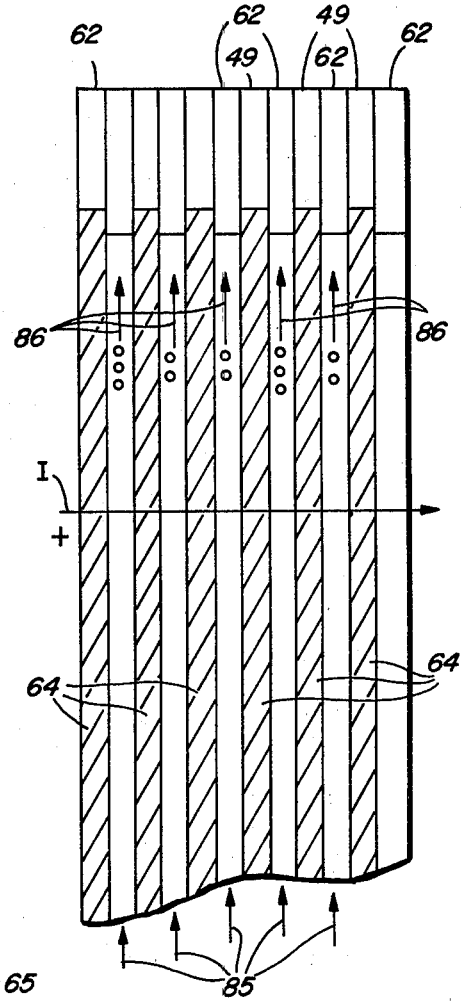
FIG. 13

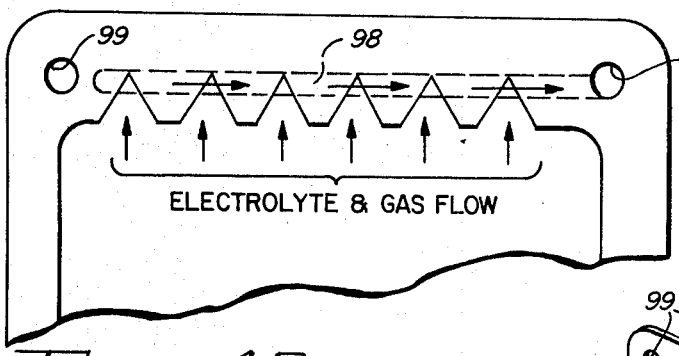
FIG. 18
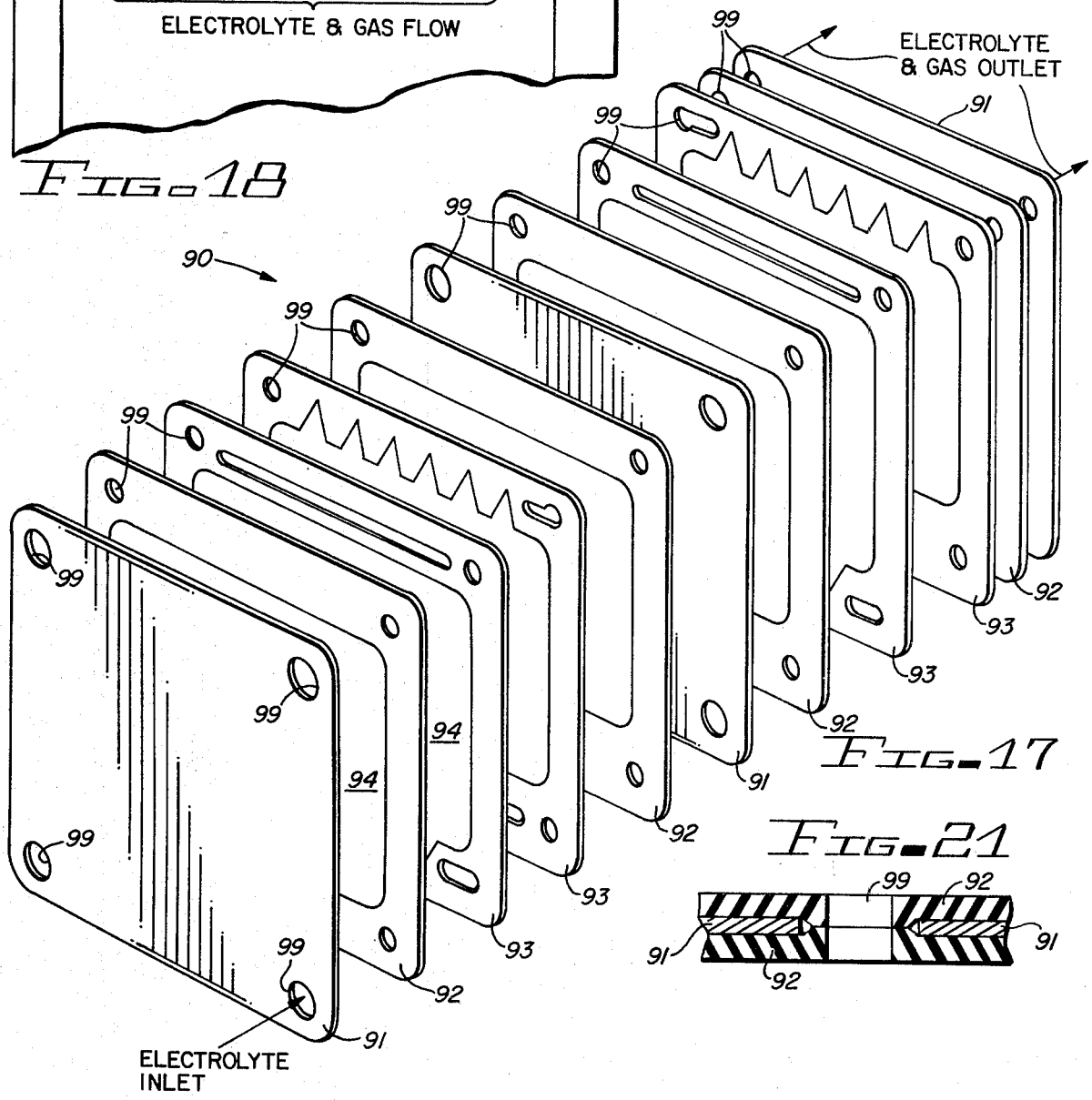
FIG. 17
FIG. 21
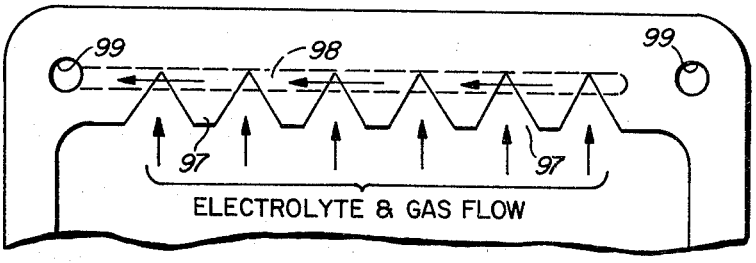
FIG. 19

POLYCELL GAS GENERATOR

BACKGROUND OF THE INVENTION

This invention relates to electrolysis and more particularly to the electrolysis of water for the generation of hydrogen and oxygen, the combination of which is commonly referred to as detonating gas.

Electrolysis is a process in which an electric current is passed through a liquid causing a chemical reaction to take place. If the liquid is water, electrolysis "breaks up" the water into two gases, namely hydrogen and oxygen. In the electrolysis of water, the hydrogen gas collects at the cathode electrode and the oxygen gas collects at the anode electrode of the gas generator. Because pure water is not a suitable conductor of electricity, a salt such as potassium hydroxide is added to the water to form an electrically conductive solution. Such a solution is known as an electrolyte. This process generates gas as a function of the surface area of the anode and cathode electrodes in contact with the electrolyte and directly proportional to the amount of current flowing through the gas generator.

One important practical use of the detonating gas produced by this means is as a fuel for welding equipment. In this type of application, the proportions of oxygen and hydrogen produced by electrolysis (one part oxygen is two parts hydrogen) exactly matches the proportions needed for recombination (combustion) in the flame of an associated welding torch.

DESCRIPTION OF THE PRIOR ART

Present day apparatus in use for generating detonating gas are generally very bulky and inefficient devices. Because of their poor operating characteristics, they have not been ideally suited for use in mobile or portable equipment.

Although many patents have issued over the years directed to electrolysis equipment, none have developed an efficient compact polycell configuration disclosed and claimed herein.

U.S. Pat. No. 3,616,436 discloses a single pair of anode and cathode electrodes in a single electrolytic cell for the production of oxygen.

U.S. Pat. No. 3,451,906 discloses a multi-cell apparatus for the production of halates, perhalates or hypohalates of alkali metals.

U.S. Pat. No. 3,518,180 describes a bipolar electrolytic cell and an assembly comprising a multiplicity of such cells for use in producing chlorates and perchlorates.

U.S. Pat. No. 3,692,661 describes an apparatus for removing pollutants and ions from liquids.

U.S. Pat. No. 3,824,172 describes an electrolytic cell for the production of alkali metal chlorates.

U.S. Pat. Nos. 3,957,618; 3,990,962; 4,014,777 and 4,206,029 describe further apparatus for the generation of detonating gas.

U.S. Pat. No. 3,994,798 describes an electrode assembly for use in multi-cell electrolysis apparatus.

U.S. Pat. No. 4,124,480 describes a bipolar cell for use primarily in the manufacture of sodium hypochlorite.

In U.S. Pat. Nos. 3,451,906; 3,518,180; 3,957,618; 3,990,962; 4,014,777; 3,994,798 and 4,124,480, the individual cells are serially energized by an electric current. This is desirable because it results in reduced current requirements at higher voltages resulting in higher electrical efficiency because of the reduced rectifier losses.

In U.S. Pat. Nos. 3,451,906 and 4,014,777, the devices disclosed employ several cells arranged in parallel rather than in series relative to the flow of the electrolyte. Thus, all the cells are operated at the same hydraulic pressure. This arrangement promotes rapid electrolyte circulation which is desirable for cooling as well as for sweeping out the generated gas, thereby maintaining maximum contact between the electrolyte and the electrode surfaces. Low operating temperatures and high gas generation rates are thus achieved.

It will be noted that the apparatus described in U.S. Pat. No. 4,014,777 embodies both of the desirable features listed thus far, i.e., series electric current flow through the cells and parallel electrolyte flow across its plates. In the structure of U.S. Pat. No. 4,014,777, however, the openings forming the electrolyte inlet and outlet ports introduce a shunt or leakage current path between adjacent cells which, by virtue of their series electrical arrangement, are at different electric potentials. These leakage currents account for electrical losses which reduce the overall efficiency of the apparatus. This same deficiency is to be noted to some extent in the other serially energized devices disclosed in U.S. Pat. Nos. 3,518,180; 3,957,618; 3,990,962; 3,994,798 and 4,124,480. To minimize such leakage currents and their associated losses, the inlet and outlet ports should be designed or arranged in a manner such that the ratio of the length of the path through each port to the cross-sectional dimension of the same path is considerably greater than unity. The inlet and outlet tubes provided in the device disclosed in U.S. Pat. No. 3,451,906 tend to reduce such losses but fail to accomplish the results claimed herein, including portability and low cost, particularly for applications such as welding, respirators, etc. Further, none of the modifications disclosed herein separates the hydrogen and oxygen gases as they are generated.

SUMMARY OF THE INVENTION

In accordance with the invention claimed, a highly efficient gas generator is provided utilizing a novel cell configuration that provides a series electrical current path through its several cells in combination with parallel electrolyte paths through the cells. The assembly is characterized by low cost, portability and minimum leakage currents.

It is, therefore, one object of the present invention to provide a new and improved electrolytic gas generator.

Another object of this invention is to provide an efficient gas generator for producing hydrogen and oxygen gases.

A further object of the invention is to provide an improved and efficient gas generator employing the series flow of electrical current in combination with parallel electrolyte flow through the several cells of the generating device in a compact, novel and efficient polycell gas generator.

A still further object of this invention is to enhance the operating efficiency of gas generators by the use of a physical arrangement of parts in which the electrolyte flow is unidirectional in a straight line and orthogonal with respect to electric current flow through the cell.

A still further object of this invention is to implement such simultaneous series electrical current flow and parallel electrolyte flow in conjunction with a novel arrangement of the inlet and outlet electrolyte ports which effectively reduces leakage currents and the associated electrical losses.

A still further object of this invention is to provide an improved gas generator which separates and discharges separately the generated hydrogen and the oxygen gases.

These and other objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which:

FIG. 9 is an exploded perspective view showing three key elements of the assembly of FIG. 2 with the elements spaced apart to permit an illustration of the electrolyte and gas flow paths through the inlet and outlet ports;

FIG. 12 shows the order in which the separator frames, electrode frames and electrodes are stacked in a second embodiment of the invention;

FIG. 13 is a cross-sectional view of the second embodiment of the invention in which the elements are stacked in the order shown in FIG. 12;

FIG. 17 is an exploded perspective view of a modification of the gas generators shown in FIGS. 1–13 with the bolt holes of the various separator frames, gasket seals and electrodes shown in FIGS. 14–16 embodied in FIG. 17 omitted for the sake of clarity;

FIG. 18 is a partial plan view of a pair of separator frames on one side of the electrode, one turned 180 degrees from the other forming adjacent parts of the assembly shown in FIG. 1 and showing the electrolyte and gas flow in one direction;

FIG. 19 is a partial plan view of a pair of separator frames on the other side of the electrode, one turned 180 degrees from the other forming adjacent parts of the assembly shown in FIG. 17 and showing the electrolyte and gas flow in a second direction;

FIG. 21 illustrates a partial cross-sectional view of two gaskets each on a different side of a nickel foil electrode illustrating how the gasket forms a seal around the electrolyte and gas flow through holes in the nickel foil plate.

DESCRIPTION OF THE PREFERRED EMBODIMENT

Figure 1:
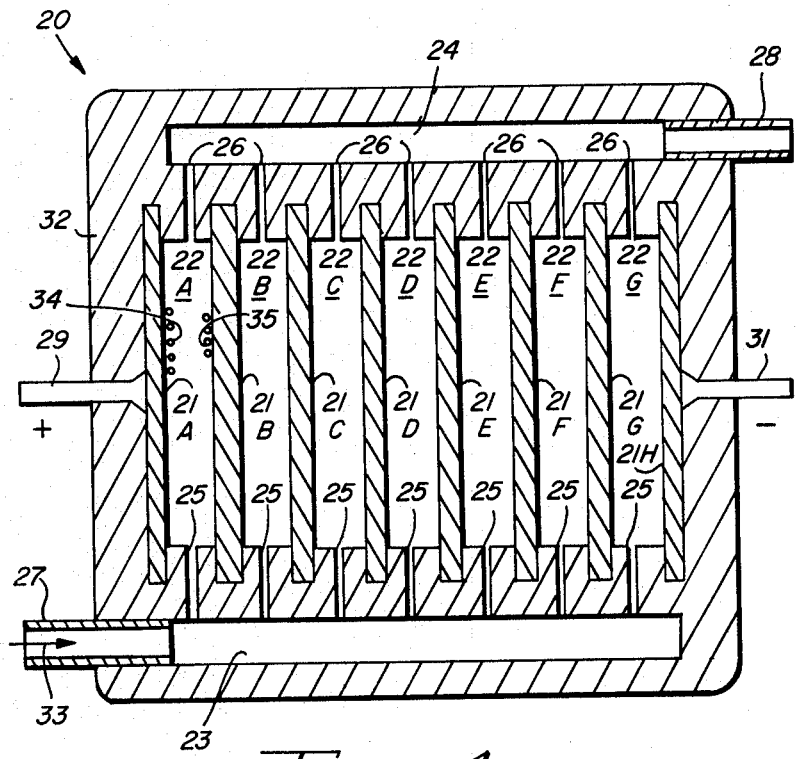
FIG. 1 is a simplified functional diagram of the improved gas generator of the invention.

Referring more particularly to the drawings by characters of reference, FIG. 1 discloses an improved gas generator 20 comprising parallel, spaced apart plate electrodes 21A–21H, electrolysis chambers 22A–22G, an electrolyte inlet manifold 23, a gas and electrolyte outlet manifold 24, inlet ports 25, outlet ports 26, an electrolyte supply port 27, a gas and electrolyte delivery port 28, a positive terminal 29 and a negative terminal 31. The generator 20 is enclosed in a sealed and electrically insulated housing 32 forming a cavity within which the chambers 22A–22G are formed.

In the particular implementation of generator 20 that is of primary interest to this invention, the generator is employed in the electrolysis of water for the generation of detonating gas. The electrolyte employed is a solution of potassium hydroxide (KOH) and distilled water, the potassium hydroxide being employed to provide electrical conductivity. The electrodes 21A–21H are flat rectangular plates which may be made from nickel sheet stock.

In the operation of generator 20, electrolyte 33 enters port 27 and fills inlet manifold 23. From manifold 23, the electrolyte enters chambers 22A–22G via the inlet ports 25, filling chambers 22A–22G and then passes out through the outlet ports 26 into the outlet manifold 24 from which it is finally exhausted through port 28. It will be immediately recognized that the chambers 22A–22G with their inlet ports 25 and their outlet ports 26 constitute parallel flow paths between the inlet manifold 23 and the outlet manifold 24. The manifolds 23 and 24 are sufficiently large in cross-section to assure minimal pressure drops along their lengths. In addition, the entry port 27 is located at the bottom of generator 20 while the delivery port 28 is located at the top of generator 20 so that the total path length traversed by the electrolyte passing through any one of the several chambers 22A–22G is the same as that traversed by the electrolyte passing through any of the remaining chambers. These precautions assure that the electrolyte is delivered to all the chambers at the same pressure and that the flow rate through all the chambers is the same.

Electric current flow is from the positive terminal 29 to electrode 21A, through the electrolyte in chamber 22A to electrode 21B, from electrode 21B through chamber 22B to electrode 21C, through chamber 22C to electrode 21D, through chamber 22D to electrode 21E, through chamber 22E to electrode 21F through chamber 22F to electrode 21G, through chamber 22G to electrode 21H to negative terminal 31. The electrical conductivity of the electrodes 21A–21H is high so that the potential difference between adjacent electrodes 21A and 21B, 21B and 21C etc. is uniform over their mutually confronting surfaces. Current density from electrode to electrode through the intervening electrolyte is very uniform because the electrolyte is dense and under constant circulation.

Because there is a voltage drop from electrode to electrode, a potential difference exists between adjacent chambers. As a result of this difference in potential a leakage current can flow from each chamber to the adjacent chamber. Thus, for example, a leakage current flows from chamber 22A to chamber 22B. This leakage current takes two paths. The first path is from chamber 22A through its inlet port 25 to manifold 23, through the juxtapositioned inlet port 25 to chamber 22B. The second path is from chamber 22A through its outlet port 26 to manifold 24, through the juxtapositioned outlet port 26 to chamber 22B. In both cases the leakage currents are, of course, carried by the electrolyte. Leakage currents flow in like manners from chamber 22B to chamber 22C, from chamber 22C to chamber 22D, etc. These leakage currents are non-productive in terms of gas generation. They consume power and thus reduce operating efficiency, and they produce undesirable heating of the electrolyte.

To minimize the leakage currents, the inlet and outlet ports 25 and 26, respectively, are small in cross-sectional area. The length of each port should preferably be several times greater than the span or diameter of its cross-sectional configuration.

Within each of the chambers 22A–22G current flows from the more positive electrode to the more negative electrode. Thus the face of the plate electrode from which the current flows serves as the anode for that chamber while the face of the other juxtapositioned plate electrode to which the current flows becomes the cathode. It will be recognized that the opposite face of the electrode serving as a cathode for chamber 22A serves as the anode for chamber 22B. The electrode 21B and the electrodes 21C–21G are thus known as bi-polar electrodes, each having one face employed as an anode and the opposite face as a cathode. Within each chamber the current flow from anode to cathode results in the generation of oxygen and hydrogen, the oxygen 24 collecting at the anode and the hydrogen 35 collecting at the cathode. Both the oxygen and the hydrogen are swept out of the chamber by the electrolyte flowing through the chamber, the gas and electrolyte mixture passing through the outlet port 26 of each chamber into the outlet manifold 24 and thence through outlet port 28 to a collection chamber (not shown in FIG. 1).

Figure 2:
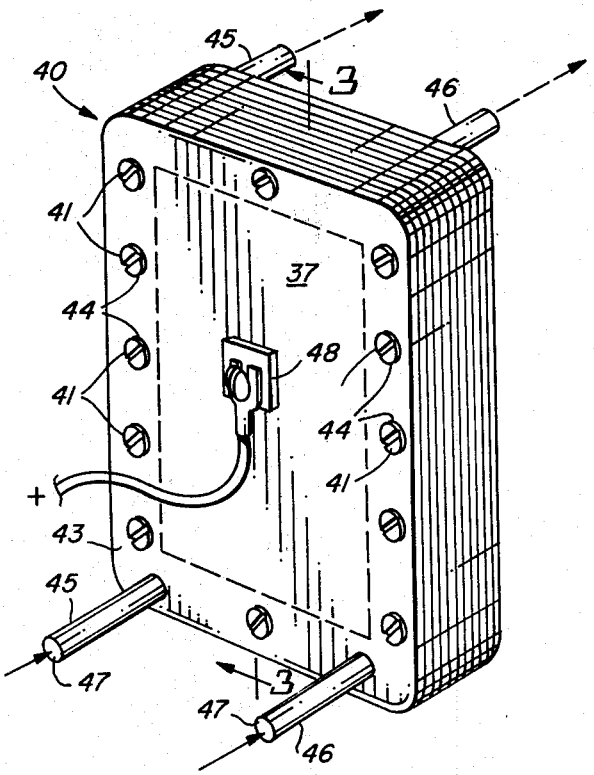
FIG. 2 is a perspective view of a first embodiment of the improved gas generator of the invention.
Figure 3:
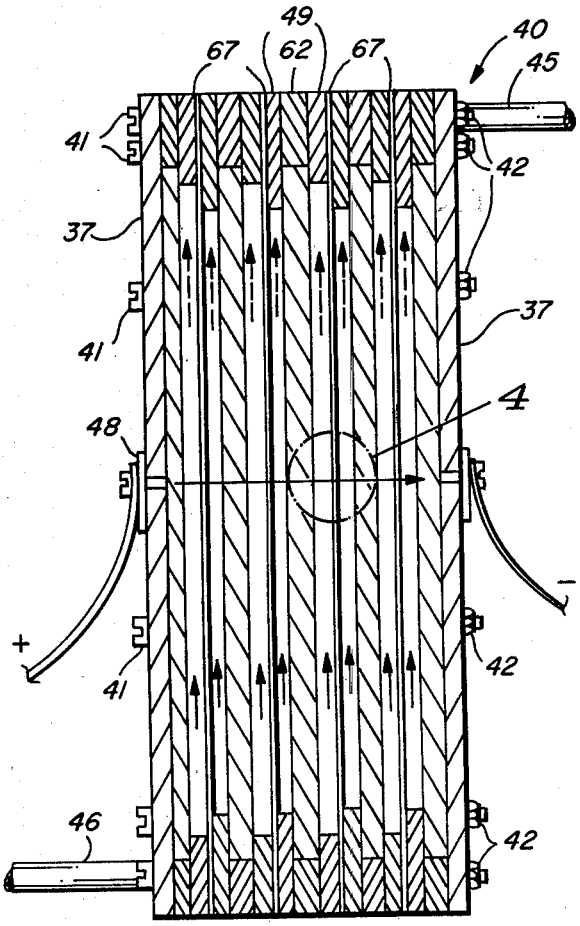
FIG. 3 is a cross-sectional view of FIG. 2 taken along the line 3—3.

Gas generator 40 of FIGS. 2 and 3 constitutes another embodiment of the invention and comprises a number of flat or planar elements stacked together between end covers or plates 37 and secured as a unit by means of bolts 41 and nuts 42.

End covers 37 comprise rectangular plates 43 molded from nylon or a similar electrically insulating material that is impervious to moisture. Holes 44 about its periphery are provided to receive bolts 41. At each end, two electrolyte (or gas and electrolyte) inlet or outlet ports 45 and 46 are provided, the ports 45 and 46 being hollow tubular and/or cylindrical configurations with their central openings 47 providing passageways through covers 37. A screw terminal 48 is provided at the center of cover 37 with the terminal providing a conductive path through the cover to a contact button (not shown) on the opposite side thereof and also providing a means for connection to the positive or negative terminal of a power supply. Two such covers 37 are employed in generator 40, one on each end of the stacked planar elements.

Figure 5:
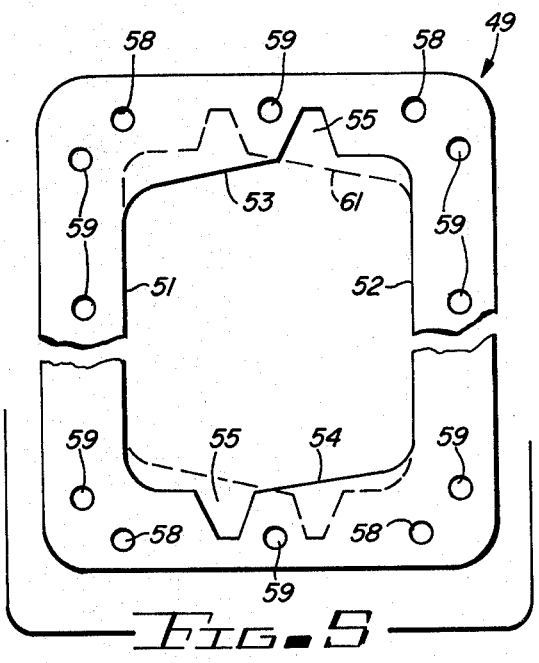
FIG. 5 is a plan view of a separator frame that is employed as an element of the assembly of FIG. 2.

FIG. 5 illustrates a spacer element 49 in the form of a rectangular nylon frame. The two longer sides 51 and 52 of element 49 are of uniform width but its ends 53 and 54 are wider at one side than at the other, the narrow side of end 53 being diagonally opposite the narrow side of end 54. Near the narrow side of each of the ends 53 and 54, a wedge-shaped indentation or notch 55 is provided. This indentation serves as a channel for the flow of electrolyte and gas, as later described. Two holes 58 are provided at each end of element 49 which serve as gas and electrolyte passageways; the remaining holes 59 which are spaced about the periphery of element 49 receive screws 41 of gas generator 40. The broken line 61 shows the contours of an identical element 49 that has been reversed to position the indentations 55 at the opposite sides of ends 53 and 54 from their positions in the solid line representation of element 49.

Figure 6:
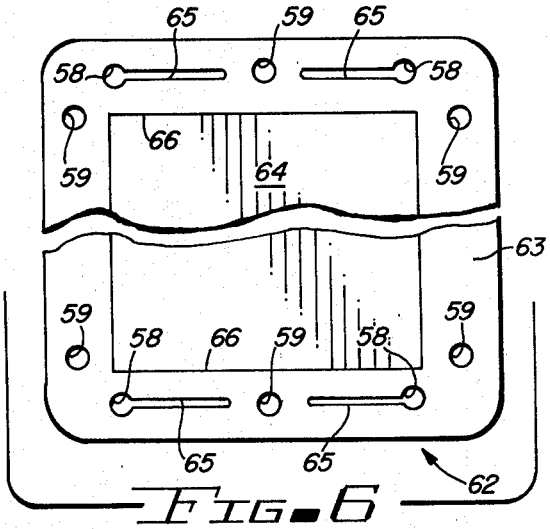
FIG. 6 is a plan view of the electrode and frame combination employed as elements of the assembly of FIG. 2.

FIG. 6 illustrates an electrode assembly 62 comprising a rectangular nylon electrode frame 63 and a rectangular plate electrode 64. Electrode 64 is formed of nickel when used in a detonating gas generator. Frame 63 comprises four sides of uniform width with a rectangular central opening appropriately dimensioned to receive electrode 64 in a snug fit. The outer dimensions of frame 63 are identical to those of element 49, and mating, identically spaced and positioned holes 58 are provided for gas and electrolyte passageways. Identically positioned screw holes 59 are also provided as in the case of element 49. A narrow slot 65 extends inwardly from each of the four holes 58 with the slots running parallel with the end members 66 of frame 63 and ending just short of the screw hole 59 located at the center of the corresponding end member 66. Slots 65 serve as gas and electrolyte passages in the assembled generator 40 as later described.

Figure 7:
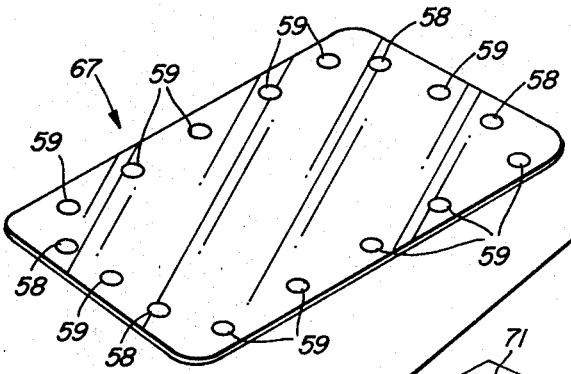
FIG. 7 is a perspective view of a cover plate and/or separator that is employed as an element of the assembly of FIG. 2.

A cellophane separator element 67, also employed as an element of gas generator 40 is shown in FIG. 7. This element has an outer dimension matching those of elements 49 and frames 63 and is provided with identically positioned mating holes 58 and 59.

Figure 8:
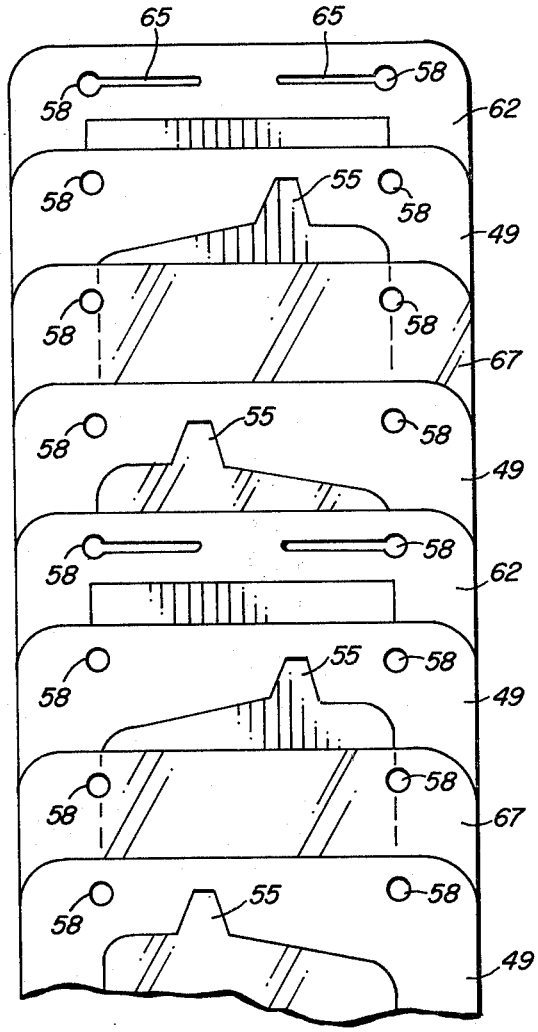
FIG. 8 is an exploded view showing a number of the individual elements that are stacked together to form the assembly of FIG. 2, the view of FIG. 8 showing the order in which the elements are stacked.

In gas generator 40 the elements just described are stacked, one directly on top of the other in the order shown in FIG. 8. From the top of the figure, the order as shown begins with an electrode assembly 62 followed by a spacer element 49, a cellophane separator element 67, another spacer element 49, another electrode assembly 62, spacer element 49, separator element 67, spacer element 49, . . . etc. Each successive spacer element 49 is reversed relative to the previous spacer element so that the position of the indentation 55 is staggered from one side to the other. In the cross-sectional view of the generator 40 as shown in FIG. 3, the elements 49, 62 and 67 are seen to be stacked in the same order as just described.

Figure 10:
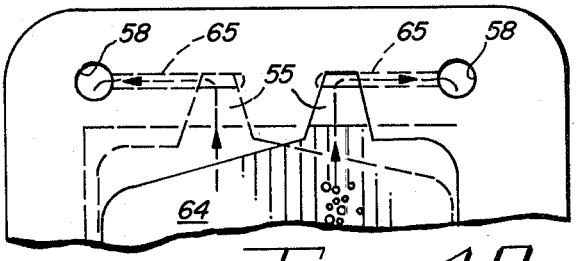
FIG. 10 is a plan view showing the three elements of FIG. 9 stacked together as in the assembly of FIG. 2, the broken lines showing contours of hidden elements.

The interrelationships between the holes 58, slots 65 and indentations 55 as they cooperate to form the inlet and outlet ports and manifolds for the electrolyte and generated gas is shown in FIGS. 9 and 10. FIGS. 9 and 10 show two spacer elements 49 stacked, one on each side of an electrode assembly 62. One of the spacer elements 49 is reversed relative to the other so that one of the indentations 55 is positioned to the left and one to the right of the center line of the gas generator.

As is also shown in FIG. 9, the holes 58 of the two spacer elements 49 and the holes 58 of the electrode assembly 62 are mutually aligned to form common passageways running perpendicularly through the stacked elements. The four holes 58 in each element form together with the four holes 58 in all the other elements, four passageways through the stacked assembly.

It will also be noted from FIG. 9 that the end of slot 65 extending from the left-hand hole 58 of electrode assembly 62 communicates with the indentation 55 of the spacer element 49 on the right side of the electrode assembly while the end of the other slot 65 extending from the right-hand hole 58 of electrode assembly communicates with the indentation 55 of the spacer element 49 on the near or left side of the electrode assembly 62. It will thus be recognized that the moving electrolyte and the gas generated on the far surface of the electrode 64 is free to flow upward along the surface of electrode 64 into the indentation 55 of the far or right sided element 49 through slot 65 and into the passageway formed by the aligned holes 58 at the upper left-hand corner of the stacked elements shown in FIG. 2. Similarly, electrolyte and gas generated on the near surface of the electrode 64 may follow the near surface of electrode 64 into indentation 55 of spacer element 49 on the near or left side of the assembly shown in FIG. 9 and into the other slot 65 and thence into the other passage formed by the aligned holes 58 at the upper right-hand corner of the stacked elements shown in FIG. 2.

The electrolyte ($H_2O+KOH$) enters the two passages at the bottom formed by the aligned holes 58. From these two passages the electrolyte follows slots 65 of electrode frame 63 to indentations 55 of spacer elements 49. Electrolyte reaching indentation 55 of element 49 on the near side as shown in FIGS. 9 and 10 flows upward out of indentation 55 along the near surface of electrode 64 while electrolyte emerging from indentation 55 of element 49 on the far side rises along the far surface of electrode 64. If current I flows perpendicularly into the near face of electrode 64 from the near side, the near face of electrode 64 becomes a cathode and the face of electrode 64 on the far side becomes an anode. The gas generated at the near surface is hydrogen and the gas generated at the far surface is oxygen. Both gases move upward along with the flow of the electrolyte, the hydrogen 68 at the near surface finds its way into indentation 55 of the near spacer element 49 following slot 65 into the passageway formed by the aligned holes 58 in the upper right hand corner of the gas generator, and the oxygen 69 generated on the far surface flows into indentation 55 of element 49 in the far side, through slot 65 into the passageway formed by the aligned holes 58 in the upper left-hand corner of the gas generator.

Slots 65 thus constitute the inlet and outlet ports corresponding to ports 25 and 26 of gas generator 20. The long and narrow proportions of slots 65 afford the high electrical impedance needed for the inlet and outlet ports to assure minimization of leakage currents.

The cellophane separator elements 67, not shown in FIGS. 9 and 10, but positioned ahead of the near element 49 and immediately to the rear of the far element 49, readily pass the ionic current flow I, but block the lateral flow of the generated gases. Because the successive spacer elements 49 are reversed to stagger the positions of the indentations 55, the oxygen is consistently diverted to the left and the hydrogen is diverted to the right side of the gas generator as described. With the aid of the cellophane separator elements 67, the generated oxygen and hydrogen gases are separated and delivered separately from gas generator 40.

Figure 4:
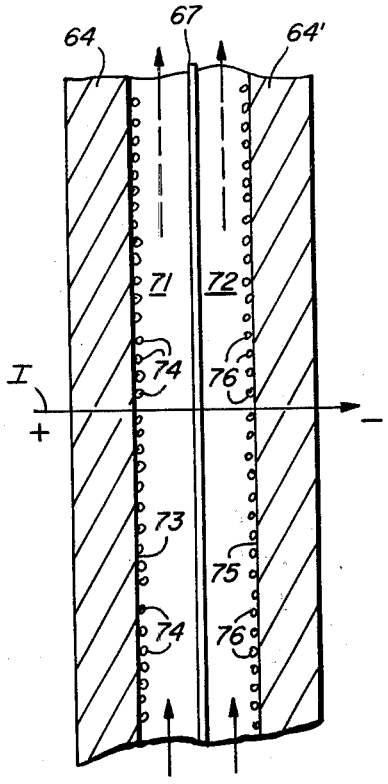
FIG. 4 is an enlarged view of the portion of FIG. 3 enclosed by circle 4.

Further clarification of the means by which the oxygen and hydrogen are isolated from each other in gas generator 40 is facilitated with reference to FIGS. 3 and 4. As shown most clearly in FIG. 4, the electric current I flows from left to right through a first electrode 64, a sheet of electrolyte 71, a separator element 67, a second sheet of electrolyte 72 and through a second electrode 64'. The sheets of electrolyte 71 and 72 flow within the window openings of spacer elements 49 positioned between electrodes 64 and 64' and separator element 67. The right hand surface 73 of electrode 64 is an anode and gas 74 generated at that surface is oxygen while the left hand surface 75 of electrode 64' is a cathode and gas 76 generated at the surface is hydrogen. While the cellophane separator element 67 readily passes the electric current I, it effectively blocks the passage of oxygen generated at surface 73 from mixing with hydrogen generated at surface 75.

The electrolyte sheets or bodies of fluid 71 and 72 are quite narrow, their thicknesses being equal to the thickness of the spacer element 49 which may be readily made as thin as desired. Close electrode spacing is thus achieved in this assembly without exposure to problems involving close mechanical tolerances. Because the adjacent electrodes 64 and 64' are closely spaced the ionic path length is short which promotes conductivity. Furthermore, the close electrode spacing assures a maximum degree of contact between the electrolyte circulated and the electrode surfaces where the gas is generated. Thus highly efficient and effective gas production is achieved in an assembly that inherently permits the separation of the oxygen and hydrogen gases.

In a totally assembled generator 40, the elements are stacked in the order shown in FIG. 8 with an electrode assembly 62 positioned at both ends of the stack. An end cover 37 is then positioned at both ends of the stack of elements, the holes 44 of cover 37 aligned with the holes 59 of the elements 49, 62 and 67. The ports 45 and 46 of the front cover are preferably positioned at the bottom of the assembly, as shown in FIGS. 2 and 3, while the ports 45 and 46 of the rear cover are positioned at the top (or vice versa), for the equalization of the parallel electrolyte path lengths through the individual cells.

With elements 49, 62 and 67 and the front and rear covers 37 stacked and aligned, as just described, screws 41 are passed through holes 44 and 59 and are secured in place by means of nuts 42. When the nuts are properly tightened a sealed assembly is achieved in which the frames of the elements are tightly compressed together so that the electrolyte is effectively contained. The containment of the electrolyte may, of course, be enhanced by prior coating of the mating element surfaces with a joint compound or sealing material.

Figure 11:
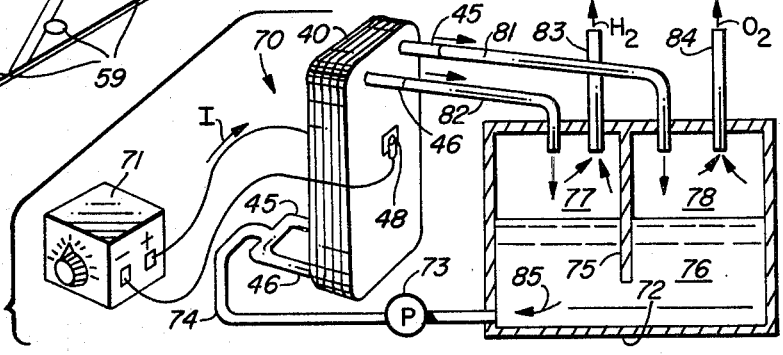
FIG. 11 is a simplified functional diagram showing the gas generator of FIG. 2 connected for operation with an electrolyte tank and a power supply.
Figure 20:
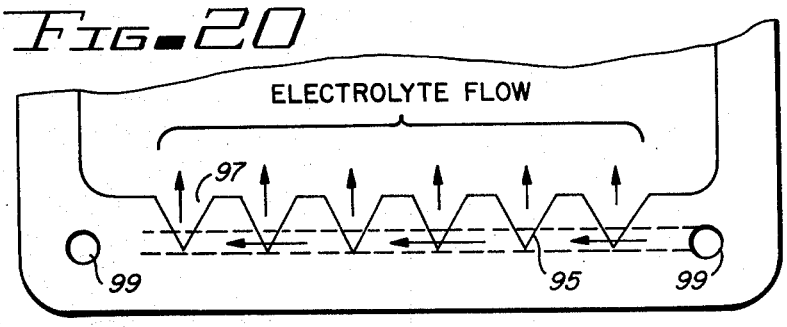
FIG. 20 is a partial plan view of the other end of the separator frames shown in FIGS. 18 and 19 illustrating the electrolyte flow into the assembly shown in FIG. 17.

FIG. 11 illustrates a complete gas generation system 70 incorporating generator 40 shown in FIG. 3, a source of electric current 71, an electrolyte and gas separator tank 72 and a pump 73. Pump 73 is serially connected in a tube 74 leading from the bottom of tank 72 to inlet ports 45 and 46 of gas generator 40. A vertical wall 75 projecting downward from the top cover of tank 72 extends below the surface of the contained electrolyte 76 to form two chambers 77 and 78 for gas collection above the surface of the electrolyte. A tube 81 connects chamber 78 to outlet port 45 of gas generator 40 and a tube 82 connects chamber 77 to outlet port 46. Gas delivery lines 83 and 84 are provided for the extraction of gas from chambers 77 and 78, respectively.

The positive terminal of source 71 is connected to terminal 48 at the inlet side of gas generator 40 and the negative terminal of source 71 is connected to terminal 48 at the outlet side of gas generator 40, both terminals making contact with the adjacent end electrode 64 so that current is supplied by source 71 and flows serially through the stacked elements of gas generator 40, as heretofore described.

Pump 73 draws electrolyte 76 from the bottom of tank 72 and delivers its to inlet ports 45 and 46 of gas generator 40 in which it follows the parallel paths through the cells formed between the stacked electrodes 64. The generated oxygen is discharged at port 45 and the generated hydrogen is discharged at port 46. Oxygen is carried by line 81 to chamber 78 along with residual electrolyte and the hydrogen is carried with residual electrolyte by line 82 to chamber 77. The residual electrolyte is collected in tank 72 while the hydrogen and oxygen are removed through lines 83 and 84, respectively.

While the gas generator described is designed to deliver the oxygen and hydrogen products separately, elements 49 and 62 may be employed in another simple arrangement if such separate gas delivery is not required as, for example, when the desired end product is detonating gas for use in welding applications.

For a gas generator of the latter type, elements 49 and 62 are stacked in the order shown in FIGS. 12 and 13. Beginning from the right or left of the assembly shown, the order begins with an electrode assembly 62 followed by a spacer element 49, another electrode assembly 62, a spacer assembly 49, etc. Each successive spacer element 49 is reversed as shown to prevent coincidence of voids in the region of the indentations 55 on opposite sides of the electrodes 64 at which points leakage currents might otherwise be introduced.

In the cross-sectional view of FIG. 13, elements 49 and 62 are stacked in the order just described with an electrode assembly 62 at each end. Current flow I is from left to right through the stacked elements and electrolyte 85 flows from the bottom to the top of the assembly in parallel paths between adjacent electrodes 64. The electrolyte flows in thin sheets orthogonally arranged with respect to the flow of electric current. The generated detonating gas 86 is exhausted at the top of the assembly through outlet ports formed in communication with indentations 55 and the slots 65 formed, respectively, in spacer elements 49 and the electrode frames 63. The perpendicular or orthogonal relationship between electric current and electrolyte flow paths results in a minimization of the electric current path length and thus is an enhancement of operating efficiency. The parallel electrolyte flow under pressure assures a maximum surface contact of high density electrolyte, minimally diminished by generated gas over much of the electrode surface for a high rate of gas generation. This condition is further enhanced as electrolyte flow rates are increased.

The previously disclosed embodiments of the multiple cell gas generator are based on the concept of circulating under pressure electrolyte through narrow chambers within a cavity of the housing of the gas generator. This concept was accomplished by using two types of plastic frames and rectangular electrode plates which were stacked into a cell assembly. The stacking arrangement and the flow pattern for this type of multicell assembly has been described with reference to FIGS. 1–13.

FIGS. 14–21 disclose a further embodiment of the invention wherein gasket seals are utilized between the electrodes and the polycell frames to prevent leakage of the electrolyte between the frames. Further, the embodiments of FIGS. 14–21 reduce the thickness of the electrodes of those shown in FIGS. 1–13 to reduce material costs and incorporate multiple inlet and outlet ports in each cell chamber to promote a uniform flow pattern through each chamber.

As shown in FIG. 17 the gas generator assembly 90 comprises a plurality of nickle foil electrodes 91, gasket seals 92 and polycell frames 93 in a particular array.

Figure 14:
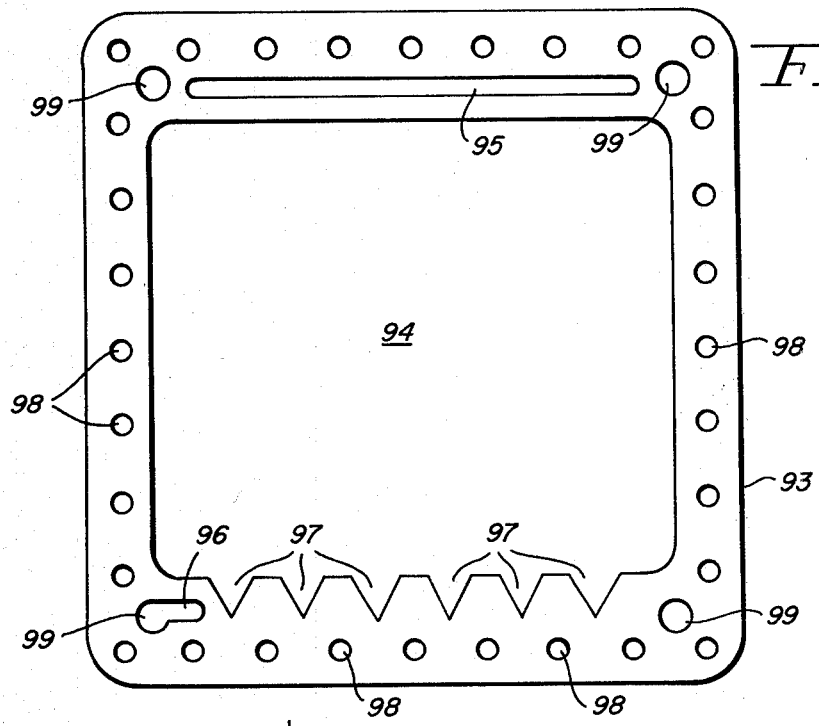
FIG. 14 is a plan view of a further modification of a separator frame employed in the assembly shown in FIG. 17.
Figure 15:
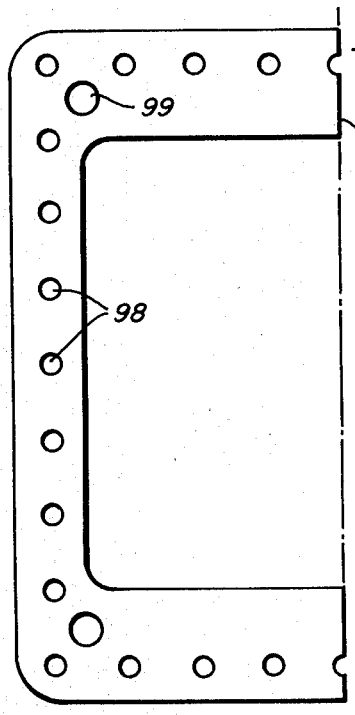
FIG. 15 is a plan view of one half of a gasket seal shown in the assembly of FIG. 17 with the other half not shown being a mirror image of the half shown.
Figure 16:
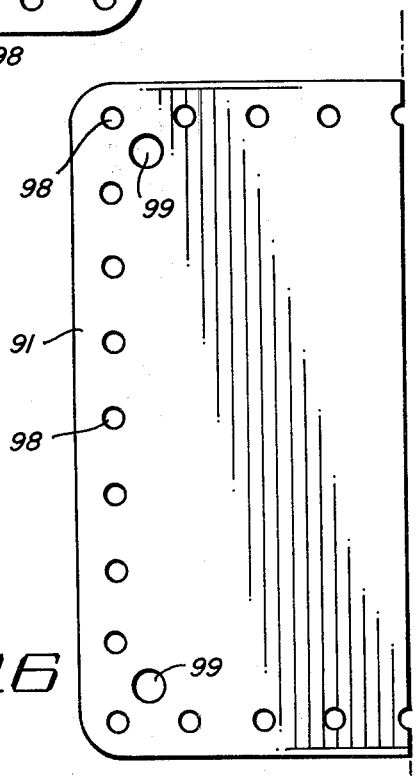
FIG. 16 is a plan view of one half of the electrode shown in the assembly of FIG. 17 with the other half not shown being a mirror image of the half shown.

FIGS. 14–16 illustrate the polycell frame 93, gasket 92 and nickle foil electrodes 91 in more detail than that shown in FIG. 17 for purposes of clarity.

The polycell frame 93 is the most essential part of the gas generator assembly 90 and is designed to form a cell chamber in its hollow interior 94, a cross feed channel 95, an orientation slot 96, a plurality of spaced notches 97 at one end thereof, a plurality of gasket screw holes 98 and feed through holes 99 for the electrolyte and generated gas flow. The feed-through holes 99, cross feed channel 95, port notches 97 and the orientation slot 95 are arranged such that two polycell frames 93 placed adjacent to each other may be rotated 180 degrees as shown to provide a desired electrolyte and gas flow pattern.

The nickel foil electrode 91 comprises a very thin electrode of approximately 0.003 inches in thickness. Not only does this relatively thin electrode save material over that of the structure shown in FIGS. 1–13 but also renders the electrode more flexible so that it can conform to minor irregularities within the assembly.

The need for gaskets 92 to provide good seals between the polycell frames 93 and the electrodes 91 and adjacent frames 93 within the gas generator 90 is dependent on the flatness and uniformity of the parts used in building the multi-cell gas generator. While it is possible to make a few precise parts and thus eliminate the need for gaskets, in production a gasket seal of the electrodes will provide more consistent results.

Since each row of feed through holes 99 within the various plates of a polycell assembly stack form a manifold, it is important to recognize that leakage currents can flow between any two electrode plates 91 wherever an electrolyte path exists. To inhibit leakage currents within any one of the manifolds the feed through holes 99 in each electrode 91 are insulated as shown in FIG. 21. The insulation of these holes occurs when the gaskets formed of resilient plastic material are compressed under the pressure of the assembly bolts and nuts 41 and 42, respectively. This resilient material is forced over the edges of these holes 99 to insulate the edges of the holes from the electrolyte flowing therethrough.

The basic operation of the multicell generator shown in FIGS. 14–21 is similar to the operation of the gas generator shown and described relative to FIGS. 12 and 13. Electrolyte is introduced under pressure through the inlet port 99 and fills all of the cell chambers 94 formed by polycell frames 93 arranged on each side of the middle electrode 91 shown in FIG. 17. An electric power source is connected to terminals 48 attached to end plates or electrodes 91. As soon as current flows through the gas generator, gas generation begins and the gas bubbles are carried or move upward to both outlet manifolds 99 simultaneously, as shown in FIG. 17.

As noted from FIGS. 1–11, a gas generator producing hydrogen and oxygen gases in a separated form has been disclosed. The assembly shown in FIG. 17 can be easily modified to produce a discrete gas generator by replacing every other electrode 91 by an identical sheet of cellophane. For example, the electrode 91 in the center of the assembly shown in FIG. 17 may be replaced by a sheet of cellophane and this generator will then separate the hydrogen from the oxygen gases as they are being generated. Because of this cellophane separator in between electrodes, the gas generated at anode surfaces does not mix with gas generated at the cathode surfaces.

It should also be noted that the multiple inlet and outlet ports formed by the spaced notches 97 into the cross feed channels 95 promotes a uniform flow pattern of the electrolyte and gases through each chamber and out of the gas generator.

In tests performed using a prototype of the gas generator of the invention, exceptionally high rates of gas generation were achieved, the exhausted mixture of gas and electrolyte exhibiting an unusually high content of gas. The high ratio of gas to residual electrolyte appeared to be sustained as the electrolyte flow rate was increased.

A highly efficient and effective gas generator is thus constructed by using the principles taught in the present invention.

Although but a few embodiments of the invention have been illustrated and described, it will be apparent to those skilled in the art that various changes and modifications may be made therein without departing from the spirit of the invention or from the scope of the appended claims.

What is claimed is:

1. A polycell gas generator comprising:

a housing defining a cavity, a plurality of parallelly arranged chambers in said housing each defining a gas generating cell, each chamber comprising a pair of spacedly positioned electrode plates defining therebetween a passageway for the simultaneous circulation under pressure of electrolyte through each of said chambers, each passageway having inlet and outlet ports extending through said housing, the lengths of the path through said housing of each port being greater than its cross-sectional width dimension, means for serially conducting ionic current across said chambers in a series arrangement laterally to the flow of electrolyte through said chambers, means for separating the gases generated at juxtapositioned surfaces of the electrode plates of each chamber, and means for collecting like gases from each of said chambers and discharging the collected gases separately from said generator.

2. A polycell gas generator comprising:

a housing defining a cavity, a plurality of parallel chambers within said housing each chamber defining a gas generating cell, a plurality of electrode plates one electrode plate positioned between adjacent chambers, each chamber having inlet and outlet ports extending through said housing, the lengths of the path through said housing of each port being greater than their cross-sectional width dimension, an inlet manifold connected to each of said inlet ports of said chambers for containing electrolyte for circulation through said chambers, an outlet manifold connected to each of said outlet ports of said chambers, said outlet manifold being larger than said inlet manifold to eliminate any pressure buildup of electrolyte within said chamber, and means for conducting electric current through said chambers in a series arrangement laterally to the flow of electrolyte through said chambers.

3. A gas generator comprising in combination:

a plurality of flat metal electrodes each mounted in an electrically insulating frame and positioned in an aligned parallel array, a plurality of insulating spacer elements each comprising a frame encircling an opening extending therethrough with one element mounted between each pair of said adjacent electrodes, a pair of cover plates one mounted at each end of the assembly of said electrodes and spacer elements with each plate serving as an electrical terminal for the gas generator, each frame of said electrodes and said spacer elements and said cover plates comprising opposed end portions, each of the frames of said elements being provided with at least a pair of notches along its inner periphery one arranged in each end portion, means for clamping the plurality of electrodes, spacer elements and cover plates together so as to provide a plurality of cells one between each pair of adjacent electrodes, the frames of said electrodes and spacer elements and said cover plates each being provided with a pair of spaced apertures extending therethrough in each end portion thereof with similarly positioned apertures in each end portion of said electrodes, spacer elements and plates being interconnected in axial alignment, a pair of slots arranged in each frame of said electrodes in each end portion thereof with one slot extending laterally from each aperture toward the longitudinal axis of said frame and communicating with one of the notches of a spacer element arranged on a predetermined side thereof, said apertures in one end portion of the spacer elements being connectable to a source of electrolyte which flows through these apertures, the slots and notches of said spacer elements and into the opening in said spacer elements between said electrodes in a parallel simultaneous manner and out said notches and the slots and apertures at the other end portion of said spacer elements.

4. The gas generator set forth in claim 3 wherein:

the distance of electrolyte flow between adjacent cells through said apertures and said slots is greater than the distance between juxtapositioned electrodes.

5. The gas generator set forth in claim 3 wherein:

the length of the path through said apertures andsaid slots in said spacer elements is greater than the mean cross-sectional dimension of said path.

6. The gas generator set forth in claim 3 wherein:

said notches in each end portion of said frames of said spacer elements is positioned off center from the longitudinal axis of the spacer element.

7. The gas generator set forth in claim 6 wherein:

each of said spacer elements is alternatively positioned as a mirror image of the other in said stack arrangement.

8. The gas generator set forth in claim 7 in further combination with:

a gas impervious spacer member positioned between each electrode in said stack arrangement for separating hydrogen and oxygen gases generated on juxtapositioned surfaces of adjacent electrodes.

9. The gas generator set forth in claim 7 in further combination with:

means for collecting and discharging like gases generated in each of said cells separately from said generator.

10. The gas generator set forth in claim 3 wherein:

said spacer elements are formed of pliable material, and said pliable material when clamped between said electrodes is distorted around the periphery of said apertures in said electrodes to insulate these electrodes from the electrolyte flowing through said apertures in said electrodes.

* * * * *